US005348231A

United States Patent [19]

Arnold et al.

[11] Patent Number: 5,348,231

[45] Date of Patent: Sep. 20, 1994

[54] TWO-STAGE AERATOR

[76] Inventors: Don C. Arnold, 1184 Windbrooke Dr. #202, Buffalo Grove, Ill. 60089; G. Michael Fravala, 7350 Old Lantern Dr., Caledonia, Mich. 49316

[21] Appl. No.: 132,142

[22] Filed: Oct. 5, 1993

[51] Int. Cl.[5] ..... E03C 1/084

[52] U.S. Cl. ..... 239/428.5; 239/447

[58] Field of Search ..... 239/428.5, 436, 443–449

[56] References Cited

U.S. PATENT DOCUMENTS

| | | | |
|---|---|---|---|
| 3,286,935 | 11/1966 | Corlett et al. | 239/428.5 |
| 3,334,818 | 8/1967 | Moen | 239/428.5 |
| 3,520,481 | 7/1970 | Moen | 239/428.5 |
| 3,524,591 | 8/1970 | Samuels et al. | 239/428.5 |
| 3,706,418 | 12/1972 | Hyde | 239/428.5 |
| 3,768,735 | 10/1973 | Ward | 239/428.5 |
| 3,884,418 | 5/1975 | Ritzenthaler et al. | 239/428.5 |
| 3,902,671 | 9/1975 | Symmons | 239/428.5 |
| 4,221,337 | 9/1980 | Shames et al. | 239/428.5 |
| 4,221,338 | 9/1980 | Shames et al. | 239/428.5 |
| 4,582,253 | 4/1986 | Gerdes | 239/428.5 |

*Primary Examiner*—Karen B. Merritt

*Attorney, Agent, or Firm*—Warner, Norcross & Judd

[57] ABSTRACT

A two-stage aerator manually operable to provide either a low-volume spray or a high-volume stream. A valve poppet maintains the aerator in the selected position so long as water is flowing through the aerator. The low-volume spray position is the default, and the aerator includes a resilient diaphragm to return the aerator to this position whenever water flow is terminated.

14 Claims, 1 Drawing Sheet

TWO-STAGE AERATOR

BACKGROUND OF THE INVENTION

The present invention relates to faucet aerators, and more particularly to such aerators manually selectable between spray and stream discharges. The term "aerator" includes nonaerating devices (e.g. laminar flow devices) as well.

In view of the need to conserve water consumption in many parts of the United States and the world, various devices for limiting water delivery on plumbing products are being developed and even mandated. Local and regional code agencies are specifying permissible water flow volumes (in gallons per minute [gpm]) on faucet aerators and shower heads. The maximum water flow presently permitted under most of these codes is now in the range of 2.0 to 2.5 gpm.

Even these restricted flows, however, may create wasteful consumption for a variety of applications, including hand washing, shaving, tooth brushing, other personal hygiene activities, and other water-using functions. Accordingly, some discharge devices have been developed, particularly for commercial applications (e.g. public washrooms) that deliver water at a much lower flow rate (e.g. 0.5 gpm) in a spray pattern. However, such devices are not practical for other applications requiring higher rates of flow.

In a separate development, two-stage aerators have also been designed to permit a user to manually select either a spray discharge or a stream discharge. Examples of such devices are illustrated in U.S. Pat. Nos. 3,706,418, issued Dec. 19, 1972 to Hyde; and 3,884,418, issued May 20, 1975 to Ritzenthaler et al. Both of these devices have a default stream flow position (aerator mode) and a manually selectable spray pattern position. The flow rates in both positions are approximately the same. Accordingly, these devices do not solve or even address water conservation issues except when equipped with additional restrictive devices that reduce flow equally in both modes.

SUMMARY OF THE INVENTION

The aforementioned problems are overcome in the present invention wherein a two-stage, two-flow, manually actuable faucet aerator is provided. The aerator includes a fixed stem assembly and a body assembly manually moveable with respect thereto. A rubber diaphragm interconnects the two assemblies to bias the body assembly to a default low-volume position, to which the aerator returns whenever water flow is interrupted. The aerator is actuable to a second, high-volume position, to permit increased flow as necessary or desirable.

The default low-volume position improves water conservation and provides an acceptable flow rate, particularly in conjunction with the preferred spray pattern, for many water-using functions, most notably hand washing. The user can grasp the body portion of the aerator and pull it down to switch the aerator to the high-volume stream position whenever a higher flow rate is desired. Consequently, high-volume flow is available for basin-filling, glass-filling, or other activities where a greater flow volume is desired. The aerator automatically returns to the default low-volume position whenever water flow is terminated and is thus ready for the next faucet use.

In a preferred aspect of the invention, the stem assembly terminates at its lower end in a popper valve. The body assembly defines a valve chamber in which the popper valve is located. The valve chamber includes upper and lower fluid discharge ports. The lower discharge port is blocked or sealed when the valve body is in the upper default position; and the upper discharge port is blocked or sealed when the valve body is pulled down to the selectable lower position. Back pressure within the valve chamber retains the valve in the selected position (against the biasing force of the diaphragm) until water flow has terminated.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 3:
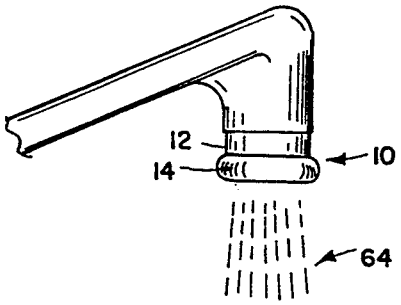
FIG. 3 is a fragmentary plan view of a faucet spout with the aerator showing the low-volume spray discharge.
Figure 4:
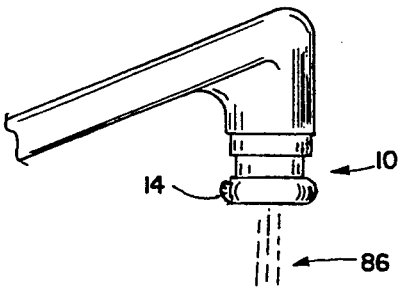
FIG. 4 is a fragmentary plan view of the faucet spout with the aerator showing the high-volume spray discharge.

An aerator constructed in accordance with a preferred embodiment of the invention is illustrated in the drawings and generally designated 10. As best seen in FIGS. 3 and 4, the aerator is mounted onto a faucet spout 12 as an original equipment (OEM) item or as a retrofit item. The default low-volume spray discharge position of the aerator 10 is illustrated in FIG. 3, and the high-volume stream discharge position of the aerator 10 is illustrated in FIG. 4. The FIG. 3 position is the default position to provide water conservation, and FIG. 4 is the user-selectable position to provide a relatively higher volume of water flow. So long as water is flowing, the aerator 10 will remain in the user selected position, unless manually returned to the low-volume position. When water flow terminates, the aerator returns to the low-flow position to be ready for the next use (FIG. 3), thereby maximizing water conservation.

Figure 1:
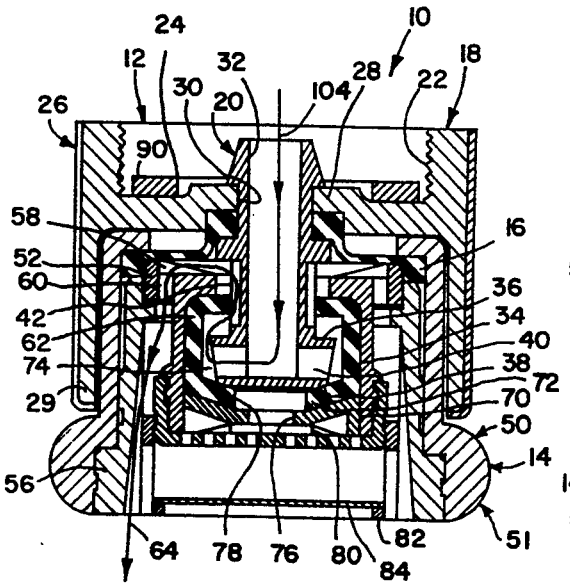
FIG. 1 is a sectional view of the aerator of the present invention in the default low-volume position.
Figure 2:
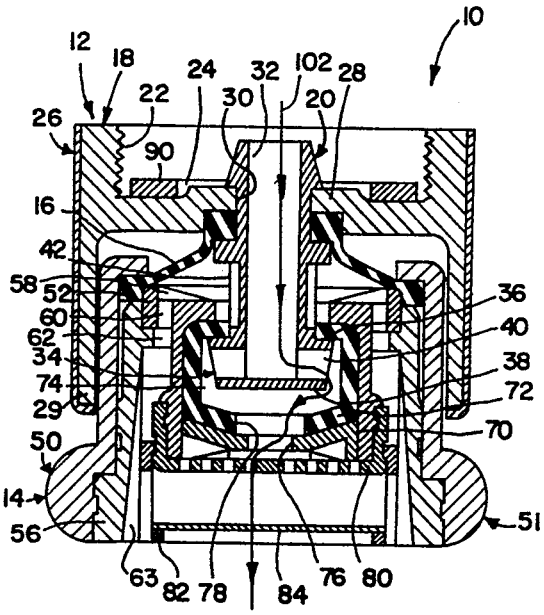
FIG. 2 is a sectional view similar to FIG. 1, but showing the aerator in the optional high-volume position.

The internal construction of the aerator 10 is best illustrated in FIGS. 1 and 2. The aerator includes a stem assembly 12 and a body assembly 14. A rubber diaphragm 16 extends between the stem assembly and the body assembly to bias the body assembly into the upper default position illustrated in FIG. 1. The resilient diaphragm 16 permits the body to be manually withdrawn without leakage to the lower position illustrated in FIG. 2.

The stem assembly 12 (FIGS. 1 and 2) includes a mounting nut 18 and a stem 20. The mounting nut shell 26 is securely mounted to the exterior of the mounting nut 18 and serves a primarily aesthetic function. Alternatively, the shell 26 may be eliminated, in which case the mounting nut 18 would be provided with an aesthetically pleasing surface finish. The mounting nut 22 includes a collar 28 defining a central opening 30 and a circumferential wall 29 extending downwardly therefrom to receive the body assembly 14. The mounting nut 18 is internally threaded, for example at 22, for installation onto a conventional faucet spout. The mounting nut 22 further defines an upwardly opening annular groove 24 in which is seated a washer 90 for sealing against a spout.

The stem 20 is fixedly secured within the mounting nut 22 and defines a longitudinal opening or through-bore 32. At its lower end, the stem 20 includes an integral valve popper 34 having an upper seat 36 and a lower seat 38. A plurality of lateral or transverse discharge openings 40 extend outwardly from the longitudinal through-bore 32 between the upper and lower seats and are in fluid connection with the through-bore. Consequently, when connected to a faucet, water flows through the through-bore 32 and out through the radial ports 40. The stem 20 also defines two or more linear grooves 42 in the stem 20 generally proximate the valve popper 34. These linear grooves provide water passage through the upper discharge port when the aerator 10 is in the default low-volume position as will be described.

The body assembly 14 (FIGS. 1 and 2) is movably mounted on the stem assembly 12. The body assembly includes an outer casing 50, a water distribution collar 52 and a shower nozzle 56. The outer casing 50 is fashioned with an outwardly extending bulbous circumferential lip 51 on its downward extreme to facilitate manual actuation between the two stages of the faucet spout device. The shower nozzle 56 is secured within the housing 50 to retain the collar 52 in the illustrated positions. The distribution collar 52 defines an upwardly opening annular groove 58 and a plurality of ports 60 in fluid communication therewith. The shower nozzle 56 also includes a plurality of ports 62 generally aligned with the ports 60 in the distribution plate 52. The shower nozzle 56 includes fluted sides 63 in a conventional pattern to discharge water in a default shower pattern, for example as illustrated at 64 in FIG. 3.

The body assembly 14 further includes a valve chamber support 70 and a chamber liner 72. The chamber support 70 fits against the distribution collar 52 and supports the valve liner 72. The valve liner is a resilient material, for example rubber, and defines a valve chamber 74 within its interior. The chamber support 70 and the valve liner 72 define aligned lower discharge ports 76 and 78, respectively, for permitting water to flow out of the chamber 74 in the selectable high-volume configuration.

A diffuser insert 80 is inserted directly below the chamber support 70 and is secured to the distribution collar 52. A screen support insert 82 is secured directly below the diffuser insert 80 and supports one or more screens 84. The diffuser 80 and the screens 84 cooperate to discharge water in an aerated stream when the aerator 10 is in the high-volume position, for example as indicated at 86 in FIG. 4. Alternatively, the diffuser 80 could be replaced by other control devices such as a laminar flow device.

Diaphragm 16 (FIGS. 1 and 2) is fabricated of a resiliently flexible material such as BUNAN (NITRILE). The diaphragm is fixedly retained both within the stem assembly 12 and the body assembly 14. The diaphragm biases the body assembly 14 to the position illustrated in FIG. 1. The resilient flexibility of the diaphragm 16 permits the body assembly 14 to be drawn downwardly to the position illustrated in FIG. 2. The diaphragm 16 provides a biasing force to return the diaphragm to the upper default (FIG. 1) position.

OPERATION

The operation of the valve is readily appreciated from a consideration of FIGS. 1–4 together. As noted above, the aerator 10 can be provided as original equipment with the faucet spout 12. Alternatively, the aerator 10 can be provided as a retrofit item on an existing faucet spout. Adapters (not shown) may be provided as necessary to connect the mounting nut within the faucet spout. These may include, for example, a female-to-male adapter.

FIG. 1 illustrates the "default" position wherein the body assembly 14 is drawn up against the stem assembly 12 under the biasing force of the diaphragm 16 and area differential, enhanced by back pressure within the valve chamber. In this position, the aerator provides a low-volume discharge of water through the shower nozzle 56. The flow path of the water in this position is illustrated by the arrow 104. In this default position, the lower surface of the popper head 34 is seated against the lower portion of the valve liner 72 to seal-off and prevent water from passing through the lower discharge port 78. Consequently, water exits the valve chamber 74 only through the upper discharge port and bypasses grooves 42 ultimately leading to the shower nozzle 56. The relative dimensions of the ports 40 and the grooves 42 are such that a back pressure or positive pressure is provided within the chamber 74. Together with the biasing force provided by the diaphragm 16, the valve is retained in the FIG. 1 position unless a positive external downward force is applied to the body 14.

Because FIG. 1 is the "default" position, the aerator defaults to the low-volume flow. This arrangement conserves water and yet provides an adequate flow for many faucet activities such as hand washing. Further, the low-volume position will be the one most likely used. The spray discharge of the default low-volume position is illustrated in FIG. 3 as 64. The discharge of water in a spray pattern in the low-volume position improves the utility of the low-volume discharge because of increased velocity of the spray as compared to a cohesive stream.

The aerator 10 can be shifted or actuated to a high-volume position after water flow has begun. The high-volume position is illustrated in FIG. 2 wherein the body assembly 14 has been pulled downwardly with respect to the stem assembly 12 overcoming the biasing force of area differential and the back pressure in the valve chamber 74. When in this position, the upper surface of the popper valve head 34 is seated against the upper portion of the chamber liner 72 to seal-off the upper discharge portion. Accordingly, water must exit the valve chamber 74 through the lower discharge port 78 and subsequently through the diffuser 80 and screens 84 to be discharged in a stream pattern as illustrated at 86 in FIG. 4. The flow path of the water in the high-volume position is illustrated by the arrow 102.

In the preferred embodiment, the discharge rate in the high-volume position (FIG. 2) is approximately 2.0 gpm maximum at 80 psi; and the discharge rate in the low-volume (FIG. 1) position is approximately 0.5 gpm at the same pressure. Of course, different relative discharge rates can be provided as desired for any particular application.

The described concept can be easily modified to produce a default high-volume flow with a selectable low-volume flow. Such a device may be desirable in shower heads where the user desires high-volume during wetting-down and rinsing, but a low-volume during lathering. This extension of the concept is within-the scope of this invention.

The above description is that of a preferred embodiment of the invention. Various alterations and changes can be made without departing from the spirit and broader aspects of the invention as defined in the claims, which are to be interpreted in accordance with the principles of patent law, including the doctrine of equivalents.

The embodiments of the invention in which an exclusive property or privilege is claimed are defined as follows:

1. A two-stage faucet spout device comprising:

attachment means for attaching said device to a faucet spout;

a body manually movable between a default position wherein water flows through said device at a default rate and a selectable position wherein water flows through said device at a selectable rate higher than the default rate;

means for retaining said body in the selected position while water is flowing through said device; and bias means for biasing said body to the default position, whereby said body returns to said default position when water flow is terminated.

2. A spout device as defined in claim 1 wherein said bias means comprises a resilient diaphragm extending between said attachment means and said body.

3. A spout device as defined in claim 1 wherein said attachment means comprises a stem terminating in a valve popper, said body defining a valve chamber in which said valve popper is retained.

4. A spout device as defined in claim 1 further comprising:

a default passage for discharging water from said spout device when said body is in the default position;

a selectable passage for discharging water from said spout device when said body is in the selectable position; and seal means for positively sealing-off said default passage when said body is in the selectable position and for positively sealing-off said selectable passage when said body is in the default position.

5. A two-stage faucet spout device comprising:

attachment means for attaching said device to a faucet spout;

a body manually movable between a default position wherein water flows through said device at a default rate and a selectable position wherein water flows through said device at a selectable rate higher than the default rate, said body including means for spray discharging water when said body is in the default position and for stream discharging water when said body is in the selectable position;

means for retaining said body in the selected position while water is flowing through said device; and bias means for biasing said body to the default position, whereby said body returns to said default position when water flow is terminated.

6. A two-stage aerator comprising:

a stem including means for mounting said aerator on a faucet spout;

a body mounted on said stem and manually movable between a low-volume default position and a high-volume selectable position, said body permitting a relatively low-volume flow when in the default position and a relatively high-volume flow when in the selectable position, said body including means for retaining said body in either the low-volume position or the high-volume position while water is flowing through said aerator; and bias means for biasing said body to the low-volume default position, whereby said body returns to the low-volume default position when water flow through said aerator is terminated.

7. An aerator as defined in claim 6 wherein said bias means comprises a resilient diaphragm extending between said stem and said body.

8. An aerator as defined in claim 6 wherein said body defines a valve chamber, and said stem includes a valve popper located within said chamber.

9. An aerator as defined in claim 6 further comprising:

spray means for discharging water in a spray pattern when said body is in the low-volume position; and stream means for discharging water in a stream when said body is in the high-volume position.

10. An aerator as defined in claim 6 further comprising:

a low-volume passage for discharging water from said aerator when said body is in the low-volume position;

a high-volume passage for discharging water from said aerator when said body is in the high-volume position; and seal means for positively sealing-off said low-volume passage when said body is in the high-volume position and for positively sealing-off said high-volume passage when said body is in the low-volume position.

11. A two-stage aerator comprising:

a stem assembly including means for attaching said stem assembly to a faucet spout, said stem assembly terminating at its lower end in a valve popper defining lateral water discharge ports;

a body assembly carried on said stem assembly, said body assembly defining a valve chamber within which said valve popper is located, said valve chamber including upper and lower discharge ports, said body assembly being movable between spray and stream positions, one of said discharge ports being closed when said body assembly is in either of the positions, whereby water exits said valve chamber through only one of said discharge ports, said body assembly having a shower spray discharge device and a stream discharge device fluidly connected with said upper and lower discharge ports respectively, said body assembly further including flow restricter means for limiting fluid flow through said spray discharge device to a significantly lower volume than fluid flow through said stream discharge device; and bias means for biasing said body assembly to the spray position, whereby said body assembly will return to said spray position when water flow is terminated to place said aerator in a default low-volume position.

12. An aerator as defined in claim 11 wherein said bias means comprises a diaphragm extending between said stem assembly and said body assembly.

13. An aerator as defined in claim 11 wherein said body assembly includes means for retaining said body assembly in the selected position while water is flowing through said aerator.

14. A two-stage faucet spout device comprising:

attachment means for attaching said device to a faucet spout;

a body manually movable between a default position wherein water is discharged from said device through a default passage at a default rate and a selectable position wherein water is discharged from said device through a selectable passage at a selectable rate different from the default rate;

means for retaining said body in the selected position while water is flowing through said device;

bias means for biasing said body to the default position, whereby said body returns to said default position when water flow is terminated; and seal means for positively sealing-off said default passage when said body is in said selectable position and for positively sealing-off said selectable passage when said body is in said default position.

* * * * *

UNITED STATES PATENT AND TRADEMARK OFFICE

CERTIFICATE OF CORRECTION

PATENT NO. : 5,348,231

DATED : September 20, 1994

INVENTOR(S) : Don C. Arnold et al

It is certified that error appears in the above-indentified patent and that said Letters Patent is hereby corrected as shown below:

Column 5, Claim 3, Line 32:
"popper" should be --poppet--

Column 5, Claim 3, Line 33:
"popper" should be --poppet--

Column 6, Claim 8, Line 15:
"popper" should be --poppet--

Column 6, Claim 11, Line 38:
"popper" should be --poppet--

Column 6, Claim 11, Line 42:
"popper" should be --poppet--

Signed and Sealed this

Twenty-ninth Day of November, 1994

*Attest:*

Bruce Lehman

BRUCE LEHMAN

*Attesting Officer*

*Commissioner of Patents and Trademarks*